US009630825B1

(12) United States Patent
Lee

(10) Patent No.: US 9,630,825 B1
(45) Date of Patent: Apr. 25, 2017

(54) CAN OPENER

(71) Applicant: Hui-Ling Lee, Caotun Township, Nantou County (TW)

(72) Inventor: Hui-Ling Lee, Caotun Township, Nantou County (TW)

( * ) Notice: Subject to any disclaimer, the term of this patent is extended or adjusted under 35 U.S.C. 154(b) by 0 days.

(21) Appl. No.: 14/940,298

(22) Filed: Nov. 13, 2015

(51) Int. Cl.
*B67B 7/72* (2006.01)
*B67B 7/00* (2006.01)

(52) U.S. Cl.
CPC ..... *B67B 7/385* (2013.01)

(58) Field of Classification Search
CPC ..... B26B 7/385
See application file for complete search history.

(56) References Cited

U.S. PATENT DOCUMENTS 6,516,524 B1 * 2/2003 Brady ..... B67B 7/385 30/404
6,886,260 B1 * 5/2005 Lee ..... B67B 7/385 30/421
7,213,340 B1 * 5/2007 Lee ..... B67B 7/385 30/416
7,574,808 B2 * 8/2009 Mah ..... B67B 7/32 30/401
7,596,874 B2 * 10/2009 Mah ..... B67B 7/34 30/401
8,371,033 B2 * 2/2013 Cantore, III ..... B25B 9/00 30/425
8,443,518 B2 * 5/2013 Fisher ..... B26B 15/00 30/2
8,955,227 B2 * 2/2015 Lee ..... B67B 7/385 30/416
9,352,947 B2 * 5/2016 Mah ..... B67B 7/34
2016/0368750 A1 * 12/2016 Kalogroulis ..... B67B 7/32

FOREIGN PATENT DOCUMENTS

DE 20 2015 106 169 U1 * 12/2015
GB 2 453 615 A * 4/2009
GB 2 455 518 A * 6/2009

* cited by examiner

*Primary Examiner* — Hwei C Payer
(74) *Attorney, Agent, or Firm* — Alan D. Kamrath; Kamrath IP Lawfirm, P.A.

(57) ABSTRACT

A can opener contains: a first holder, a second holder, a transmission device, an eccentric gear, a rotating roller, a connector, a washer, a guiding roller, and a metal piece. The first holder includes a battery chamber, a cover, and a first switch. The second holder includes a first accommodation room, a plurality of first posts, and a second accommodation room. The transmission device includes a motor, a plurality of first driving gears, and a second driving gear. The eccentric gear includes an opening and a plurality of coupling pillars. The rotating roller includes a second post, and the connector includes a second arcuate orifice, a plurality of second coupling stems, and two second positioning pillars. The washer includes a third arcuate orifice and a fixing hole. The guiding roller includes a first pore and an abutting portion, and the metal piece includes a second pore and a contacting gear.

3 Claims, 16 Drawing Sheets

CAN OPENER

FIELD OF THE INVENTION

The present invention relates to a can opener which cuts a can automatically.

BACKGROUND OF THE INVENTION

A conventional can opener contains a cutter fixed on a grip handle so as manually cut a can, but it is operated forcefully and difficultly.

The present invention has arisen to mitigate and/or obviate the afore-described disadvantages.

SUMMARY OF THE INVENTION

The primary objective of the present invention is to provide a can opener in which a button of a first switch is pressed by a user to open a can automatically, and after opening the can, the can opener removes from the can automatically, thus opening the can easily.

DETAILED DESCRIPTION OF THE PREFERRED EMBODIMENTS

Figure 1:
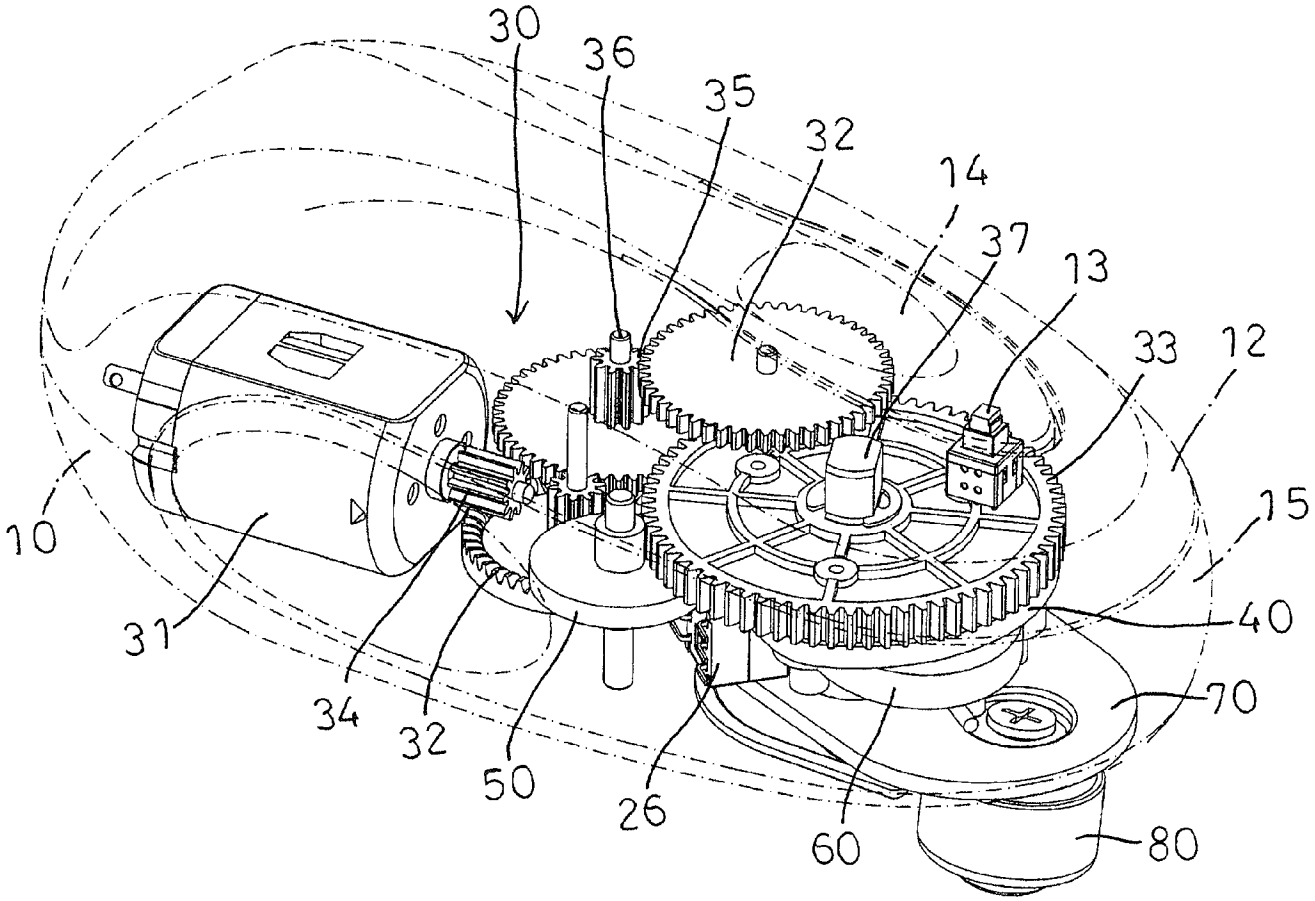
FIG. 1 is a perspective view showing the assembly of a can opener according to a preferred embodiment of the present invention.
Figure 2:
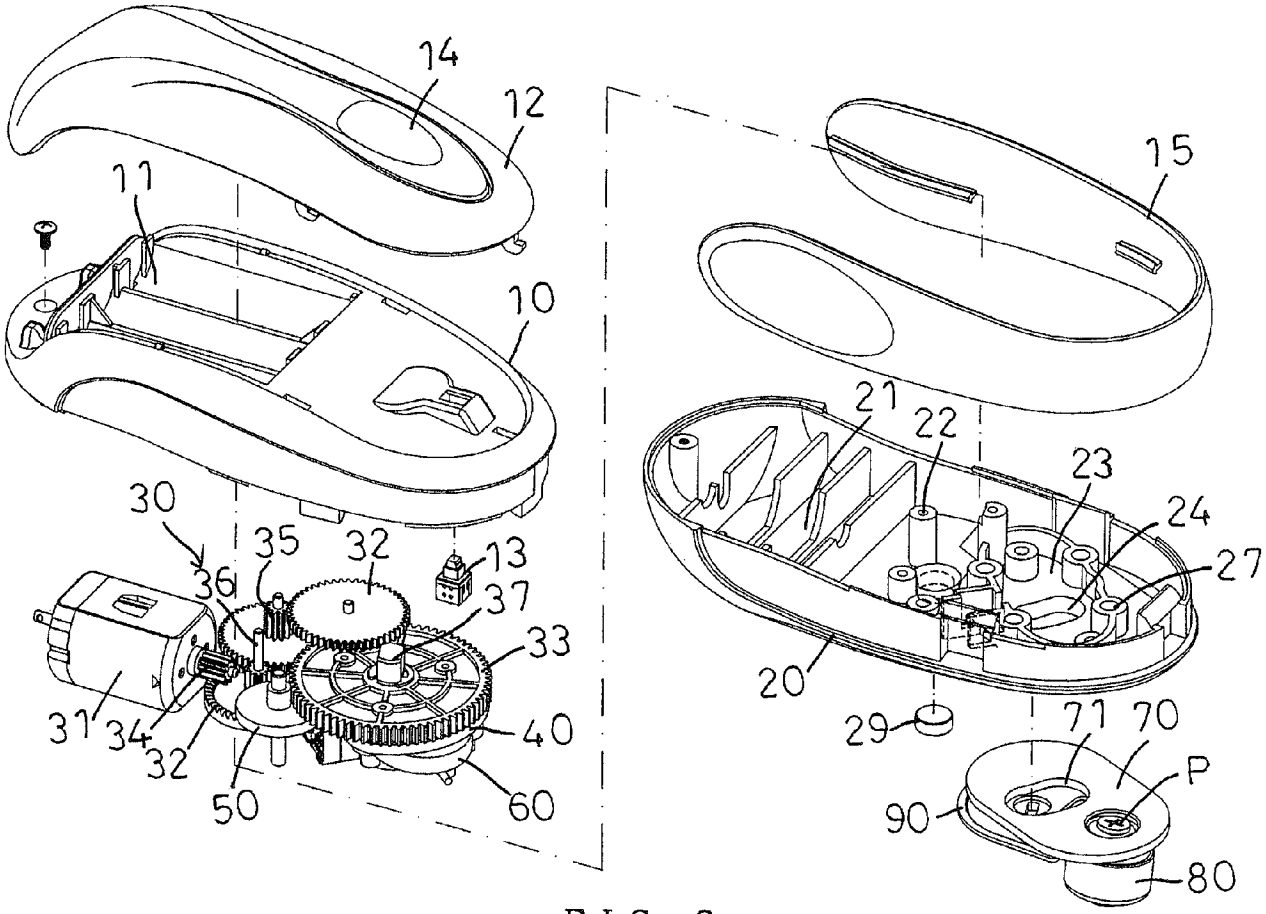
FIG. 2 is a perspective view showing the exploded components of the can opener according to the preferred embodiment of the present invention.
Figure 3:
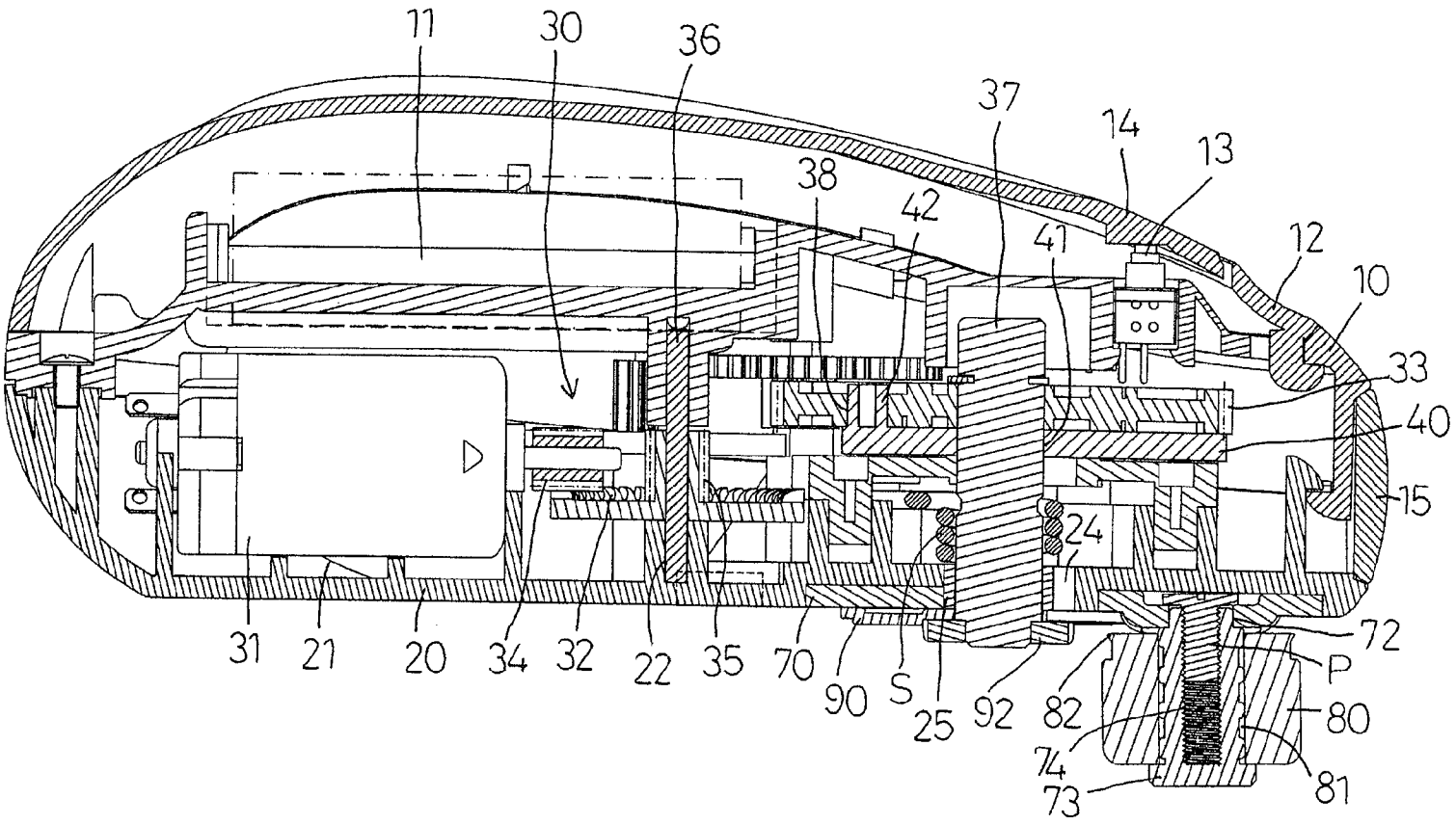
FIG. 3 is a cross sectional view showing the assembly of the can opener according to the preferred embodiment of the present invention.
Figure 4:
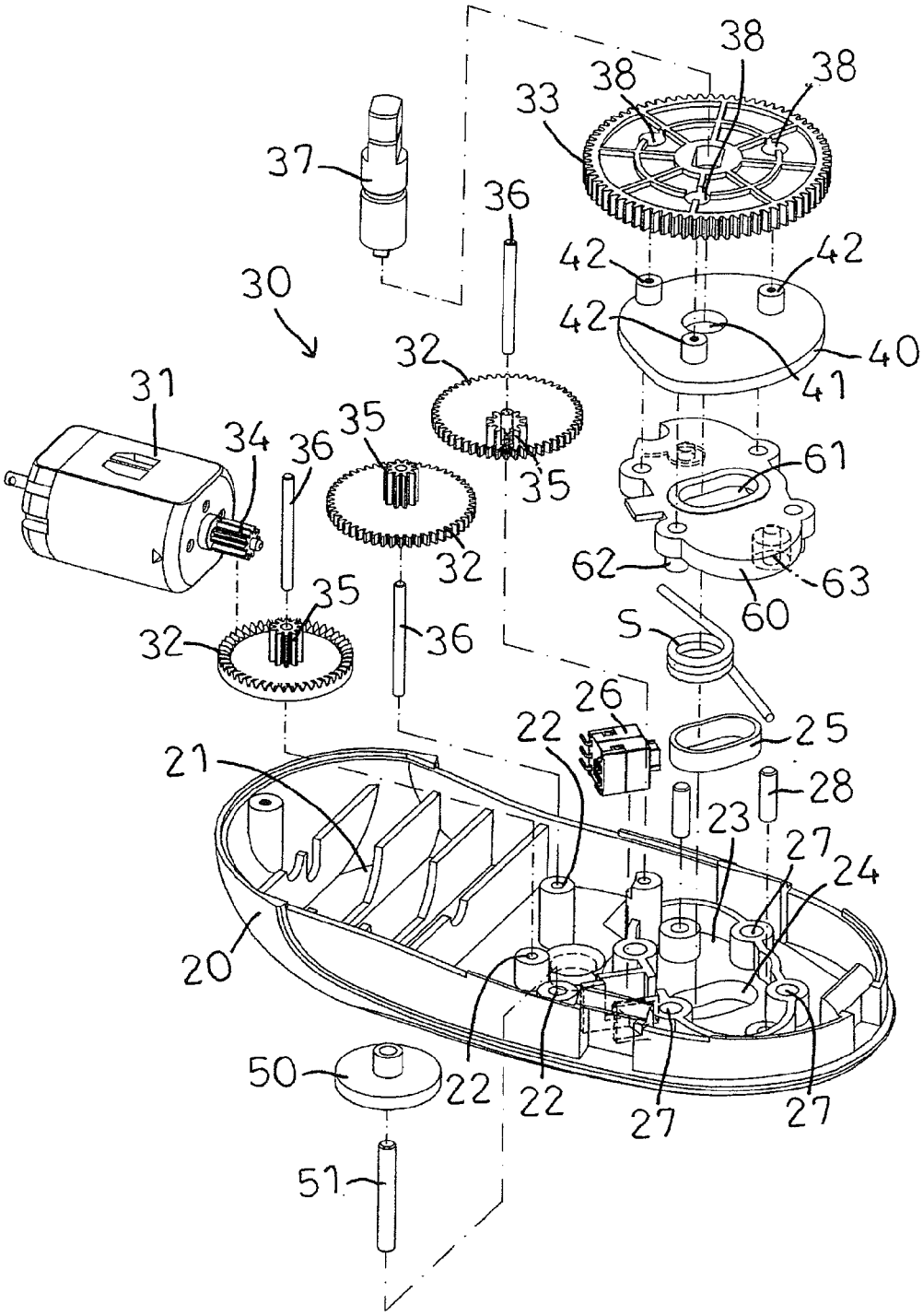
FIG. 4 is a perspective view showing the exploded components of a part of the can opener according to the preferred embodiment of the present invention.
Figure 5:
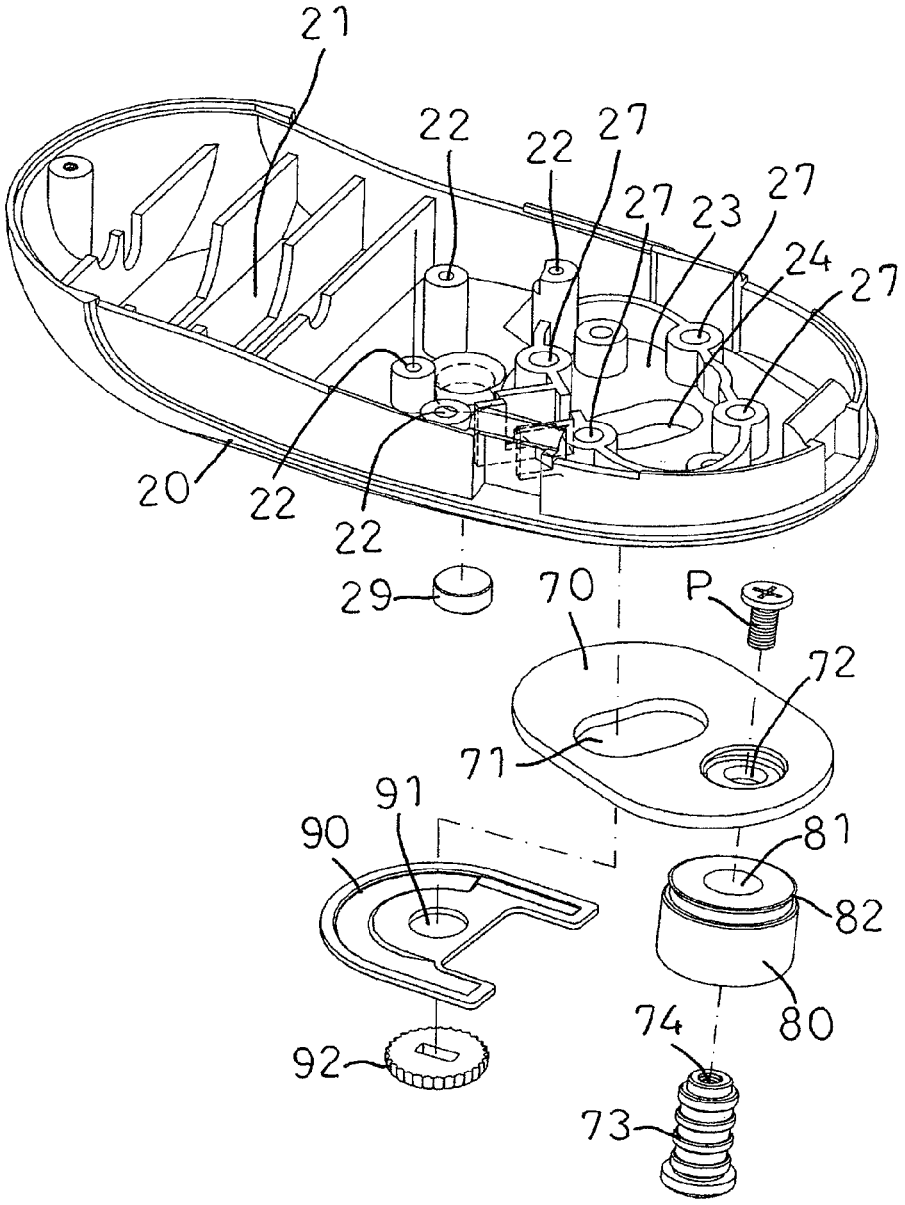
FIG. 5 is another perspective view showing the exploded components of a part of the can opener according to the preferred embodiment of the present invention.
Figure 6:
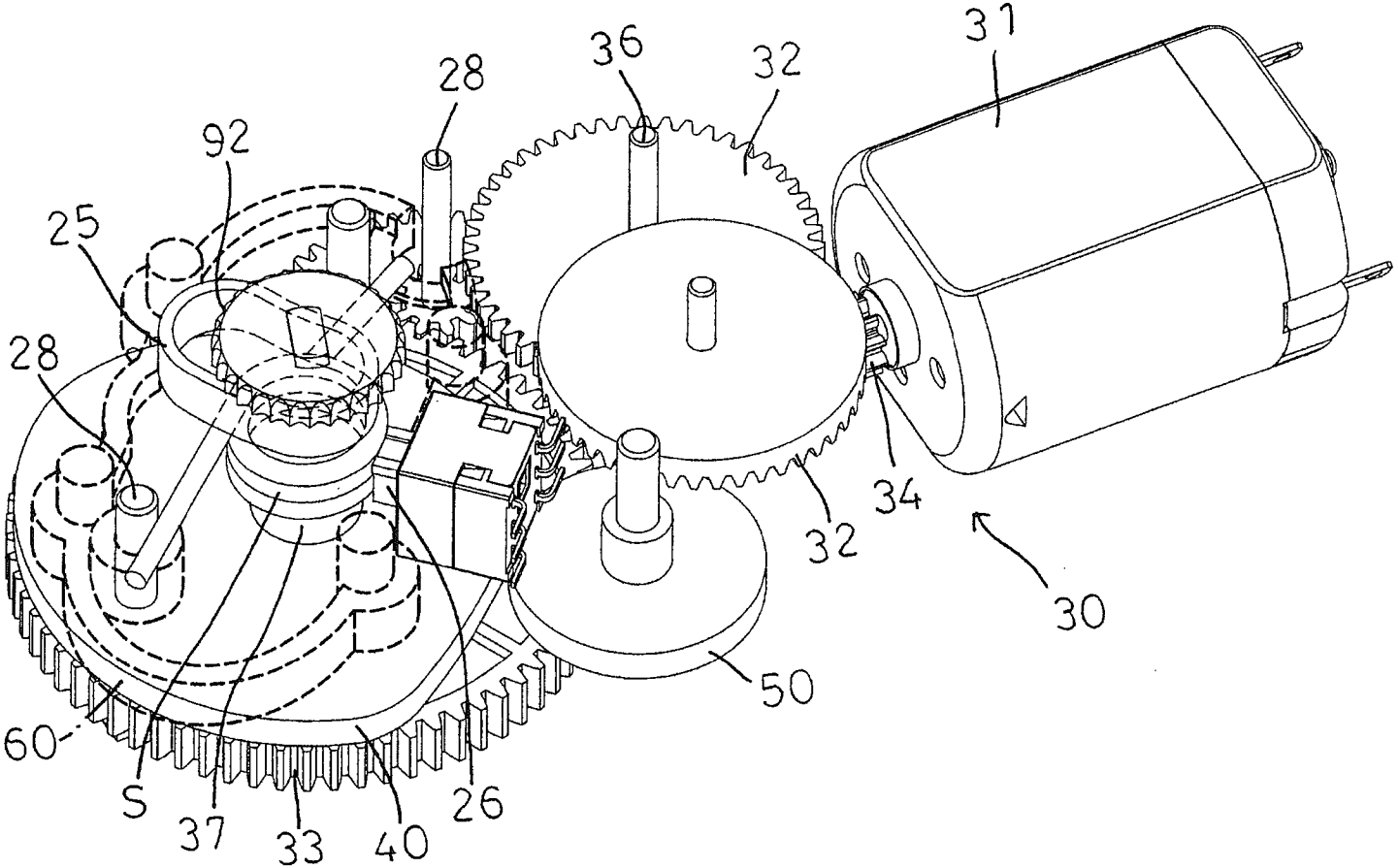
FIG. 6 is a perspective view showing the assembly of a part of the can opener according to the preferred embodiment of the present invention.

Referring to FIGS. 1 to 6, a can opener according to a preferred embodiment of the present invention comprises: a first holder 10, a second holder 20, a transmission device 30, an eccentric gear 40, a rotating roller 50, a connector 60, a washer 70, a guiding roller 80, and a metal piece 90.

The first holder 10 includes a battery chamber 11 and a cover 12 which are arranged on an upper side of the first holder 10, the second holder 20 is located below the first holder 10, and the battery chamber 11 is configured to house two batteries (not shown) configured so as to supply power source. The first holder 10 also includes a first switch 13 disposed on a front end thereof, and the cover 12 has a button 14 mounted on a front end thereof and corresponding to the first switch 13, such that the button 14 is pressed to turn on the first switch 13 so as to conduct the power source, and a C-shaped fixer 15 is fixed on the front end of the first holder 10 and the front end of the second holder 20 so as to connect the first holder 10 and the second holder 20 together.

The second holder 20 includes a first accommodation room 21 configured in a rear end thereof so as to house a motor 31, a plurality of first posts 22 arranged in the front end thereof so as to fix the transmission device 30, and a second accommodation room 23 defined in the front end thereof, wherein the second accommodation room 23 has a first arcuate orifice 24 formed therein and has an arcuate fitting element 25 arranged on an inner wall of the first arcuate orifice 24. The second holder 20 further includes a second switch 26 disposed on one side thereof and corresponding to the first arcuate orifice 24, and the second switch 26 is configured to turn off the power source after being pressed by a user. The second holder 20 further includes a plurality of first coupling stems 27 mounted on a first peripheral side of the second accommodation room 23 so as to connect with the connector 60, two first positioning pillars 28 arranged on a second peripheral side thereof so as to position two feet of a torsion spring S, and a magnetic attraction element 29 fixed on a middle portion of an outer surface thereof, wherein the washer 70 is secured on a front end of the outer surface of the second holder 20.

The transmission device 30 includes the motor 31, a plurality of first driving gears 32, and a second driving gear 33. The motor 31 has a third driving gear 34, and each first driving gear 32 has a fourth driving gear 35 fixed on a central position thereof, wherein one of the plurality of first driving gears 32 meshes with and drives the second driving gear 33 by using its fourth driving gear 35, and another of the plurality of first driving gears 32 meshes with the third driving gear 34 of the motor 31, said each first driving gear 32 is rotatably connected with each of a plurality of central shafts 36 and is fixed in each of the plurality of first posts 22 of the second holder 20, such that the motor 31 drives the second driving gear 33 to rotate via the third driving gear 34, the plurality of first driving gears 32, and the fourth driving gear 35 of said each first driving gear 32. The second driving gear 33 has a central column 37 disposed on a central position thereof and inserting into a central hole of the torsion spring S, and the second driving gear 33 also includes a plurality of connection apertures 38 formed thereon and configured to fix the eccentric gear 40.

The eccentric gear 40 includes an opening 41 corresponding to the central column 37 and configured to accommodate the central column 37, the eccentric gear 40 also includes a plurality of coupling pillars 42, and each coupling pillar 42 corresponds to and connects with each of the plurality of connection apertures 38, wherein the eccentric gear 40 is located beside the rotating roller 50.

The rotating roller 50 includes a second post 51 mounted on a central position thereof and rotatably connecting with one of the plurality of first posts 22, such that rotating roller 50 rotatably contacts with the eccentric gear 40.

The connector 60 includes a second arcuate orifice 61 corresponding to the first arcuate orifice 24 and configured to extend the central column 37 outwardly, a plurality of second coupling stems 62 corresponding to and coupling with the plurality of first coupling stems 27 of the second accommodation room 23, and two second positioning pillars 63, wherein each of the two positioning pillar 63 corresponds to and connects with each of the two first positioning pillars 28 of the second accommodation room 23.

The washer 70 includes a third arcuate orifice 71 corresponding to the first arcuate orifice 24 of the second accommodation room 23, and the washer 70 includes a fixing hole 72 defined on a front end thereof so as to accommodate a screw P and to screw with a screwing hole 74 of a shank 73, wherein the shank 73 rotatably connects with the guiding roller 80, and the metal piece 90 is fixed below the washer 70.

The guiding roller 80 includes a first pore 81 configured to accommodate the shank 73 and includes an abutting portion 82 configured to abut against a can 100.

The metal piece 90 includes a second pore 91 configured to extend the central column 37 outwardly and includes a contacting gear 92 coupled with a distal end of the central column 37 and configured to abut against the can 100.

Figure 7:
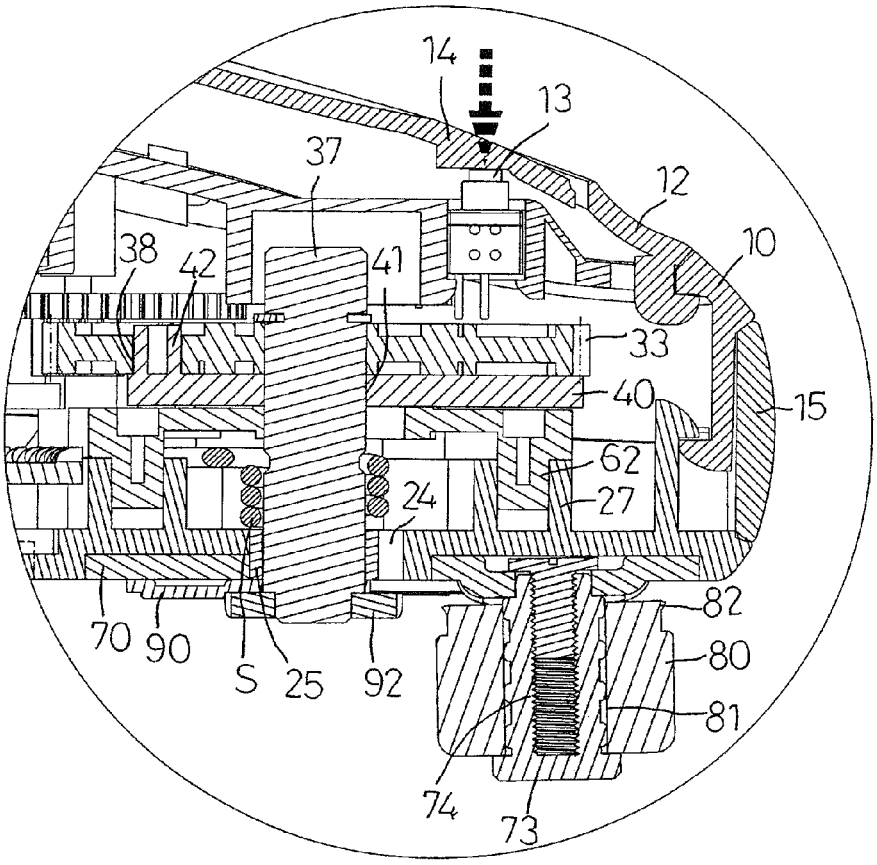
FIG. 7 is a cross sectional view showing the operation of a part of the can opener according to the preferred embodiment of the present invention.
Figure 8:
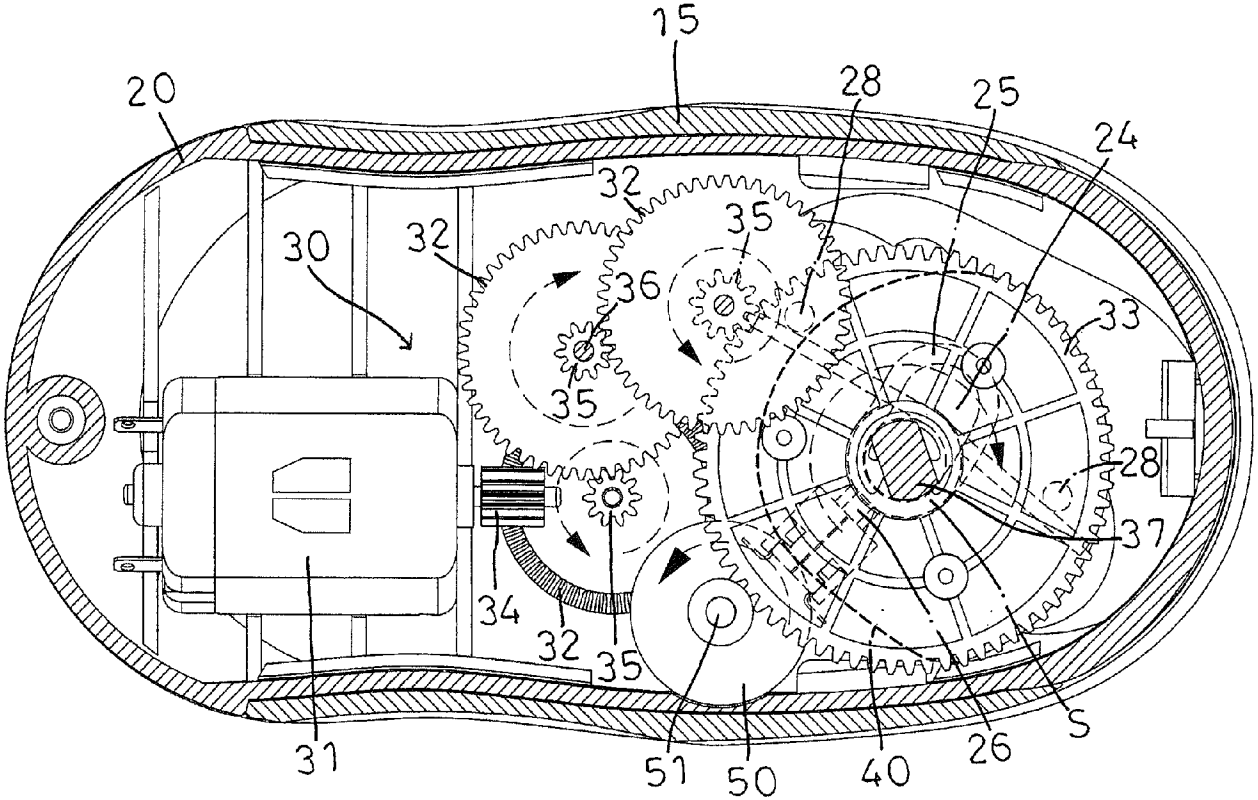
FIG. 8 is a cross sectional view showing the operation of the can opener according to the preferred embodiment of the present invention.

As shown in FIGS. 7 and 8, the button 14 is pressed by the user so as to start the first switch 13 and to drive the motor 31 of the transmission device 30 to operate.

Figure 9:
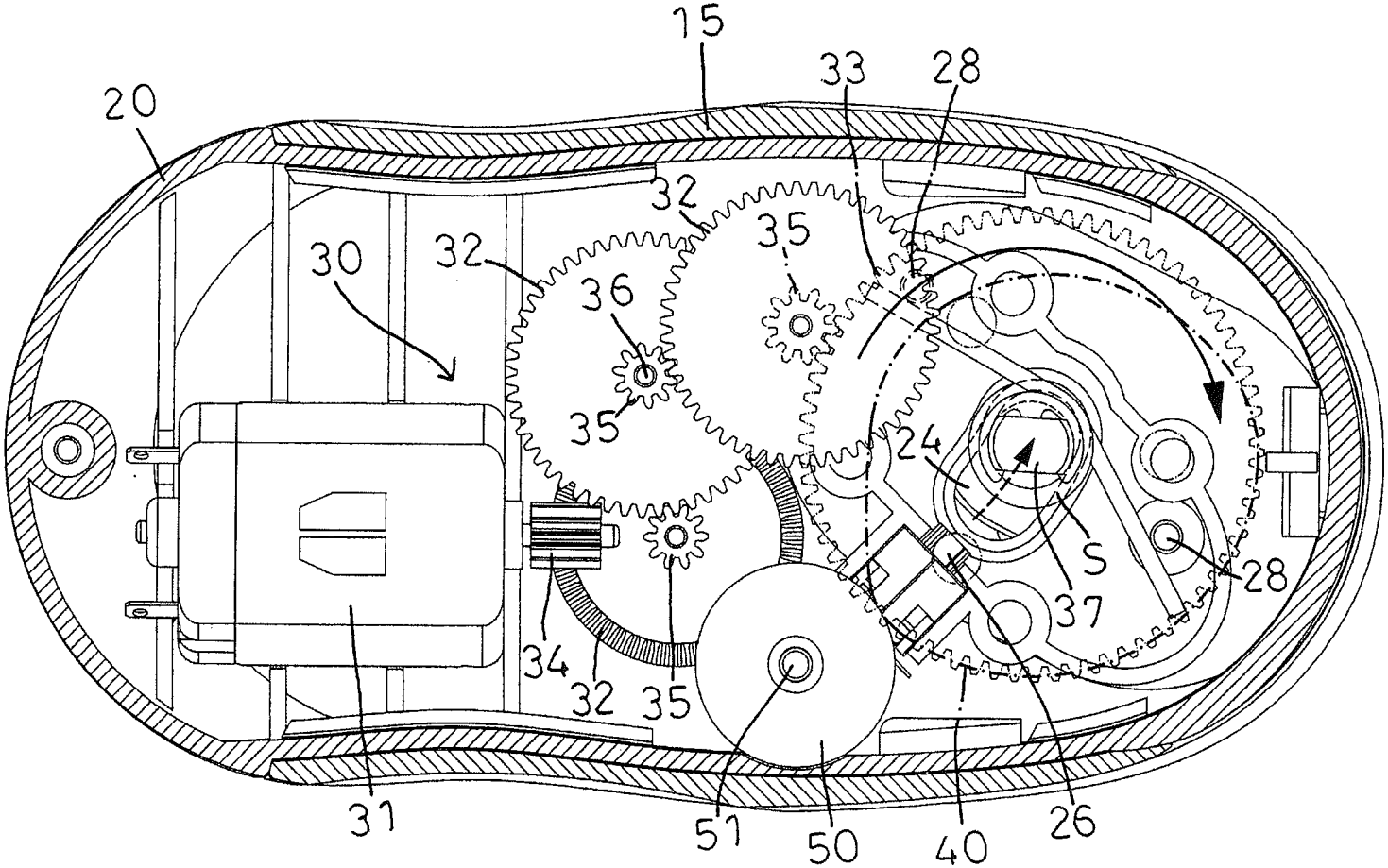
FIG. 9 is another cross sectional view showing the operation of the can opener according to the preferred embodiment of the present invention.
Figure 10:
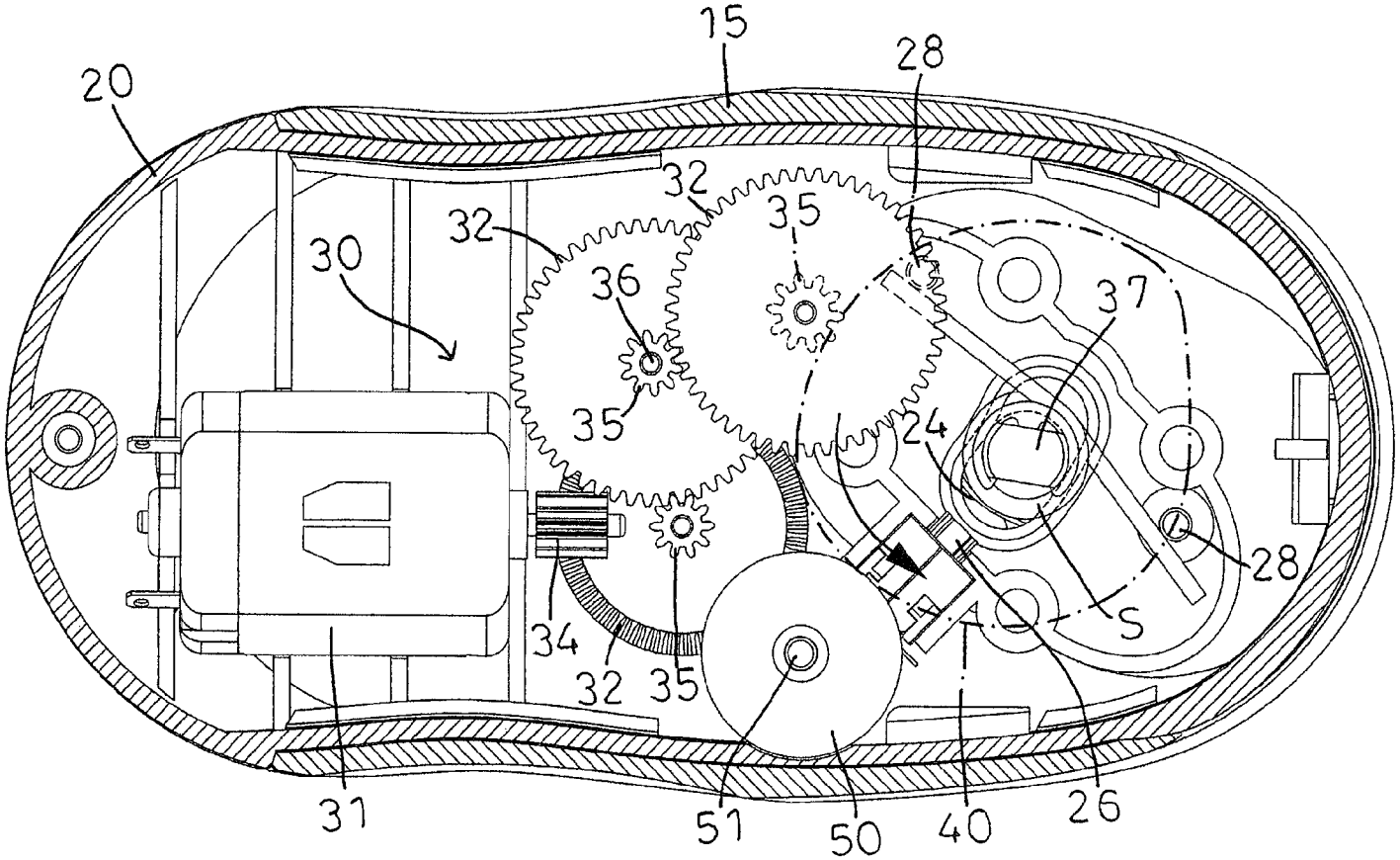
FIG. 10 is also another cross sectional view showing the operation of the can opener according to the preferred embodiment of the present invention.
Figure 11:
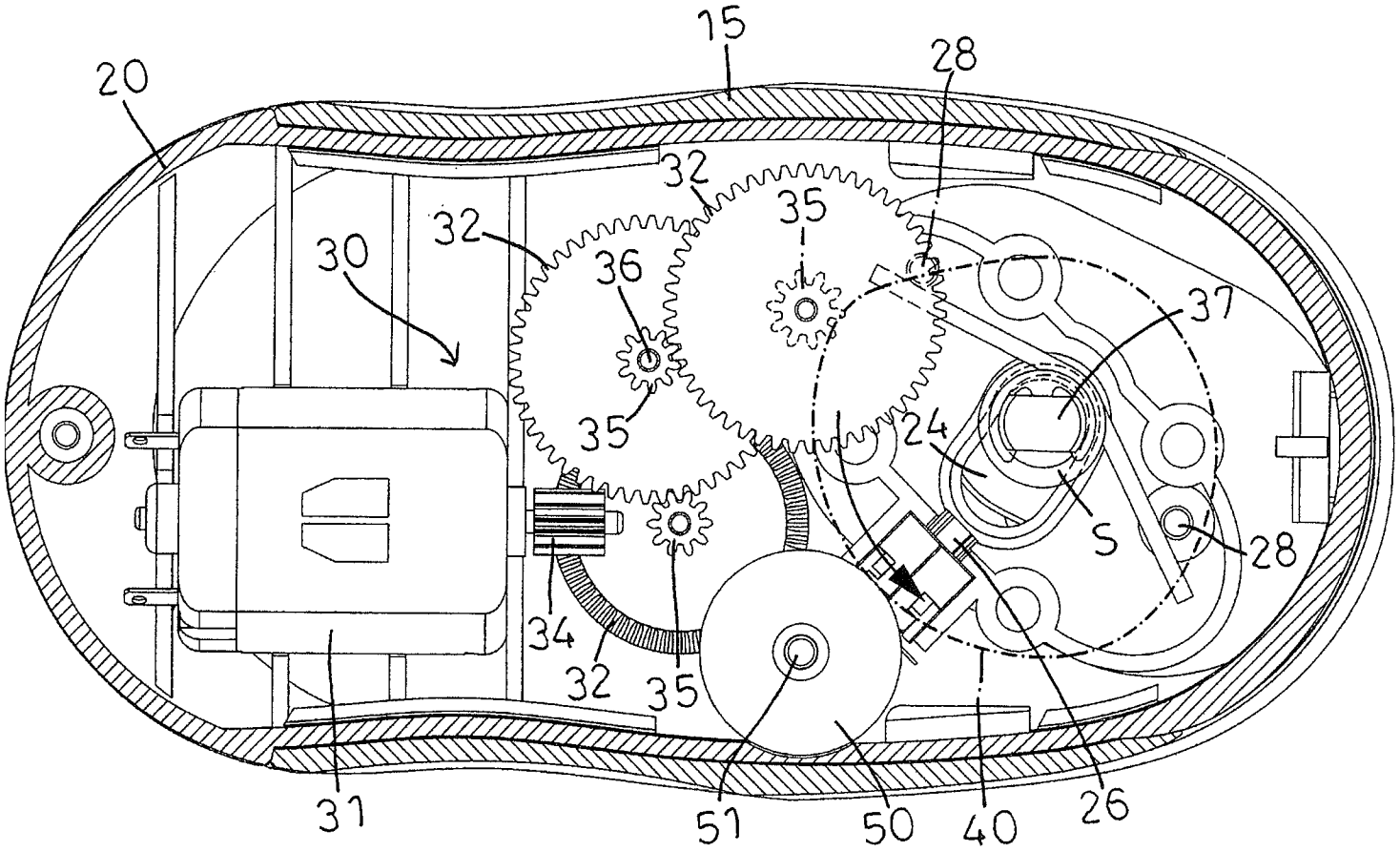
FIG. 11 is still another cross sectional view showing the operation of the can opener according to the preferred embodiment of the present invention.

Referring further to FIGS. 9 to 11, the motor 31 of the transmission device 30 drives the eccentric gear 40 and the rotating roller 50 to rotate via the third driving gear 34, the plurality of first driving gears 32, the fourth driving gear 35 of said each first driving gear 32, and the second driving gear 33, hence a distance between the second post 51 of the rotating roller 50 and the central column 37 of the eccentric gear 40 increases, and the central column 37 moves outwardly to intense a torsion force of the torsion spring S, wherein the torsion force of the torsion spring S is less than a resistance force of opening the can 100.

Figure 12:
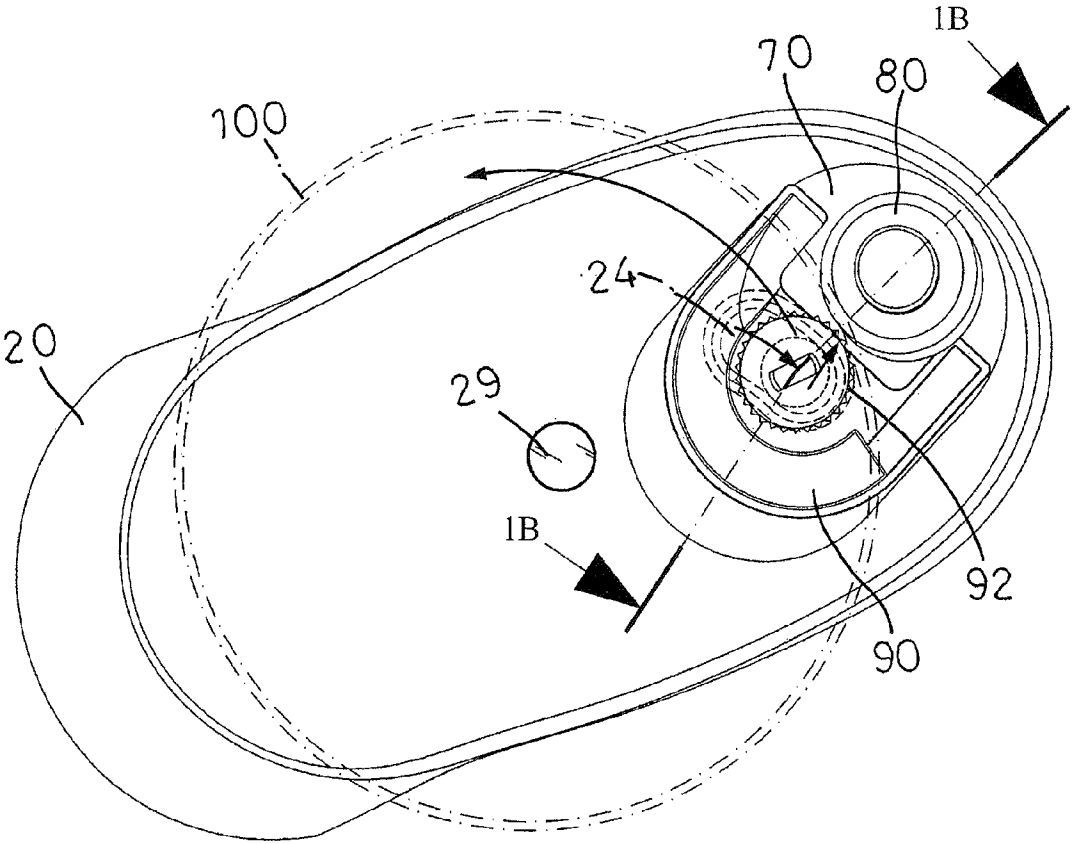
FIG. 12 is a side plane view showing the operation of the can opener according to the preferred embodiment of the present invention.
Figure 13:
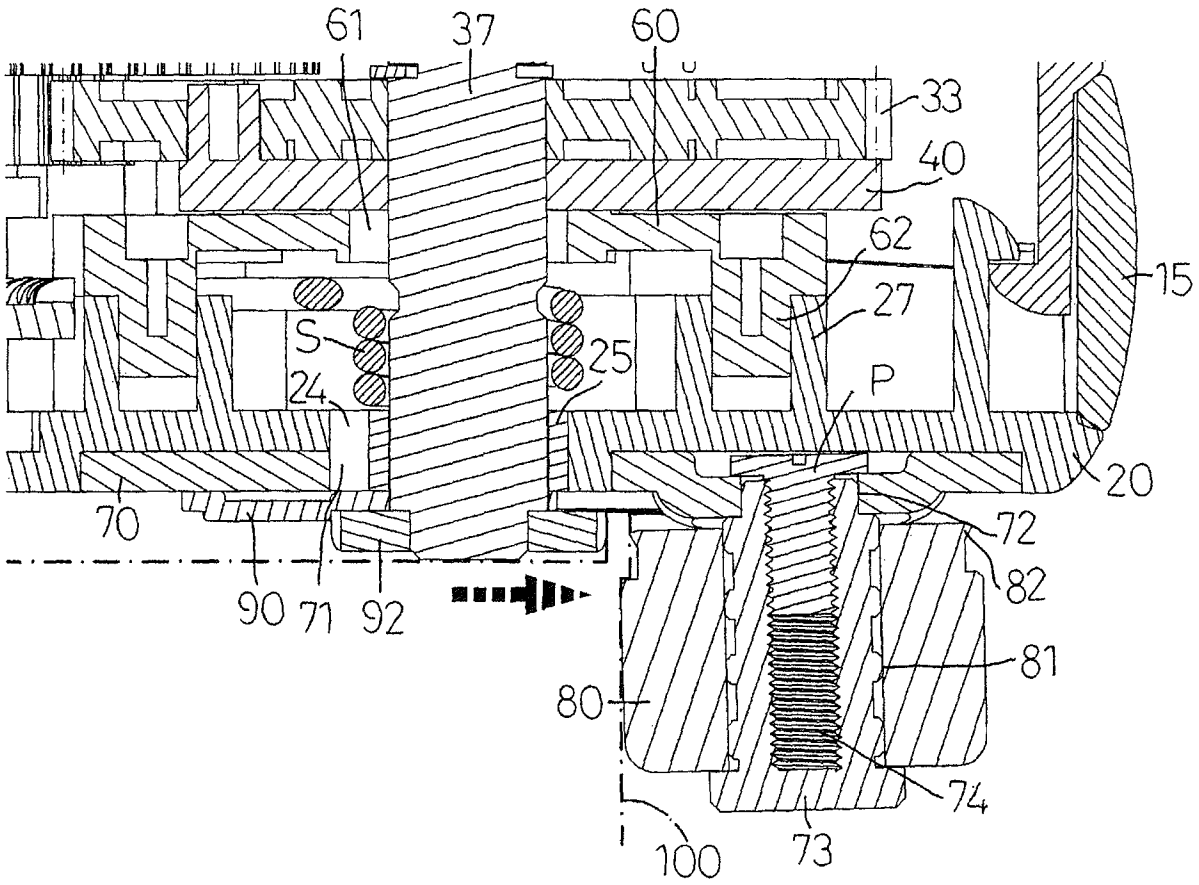
FIG. 13 is a cross sectional view taken along the line 1B-1B of FIG. 12.
Figure 14:
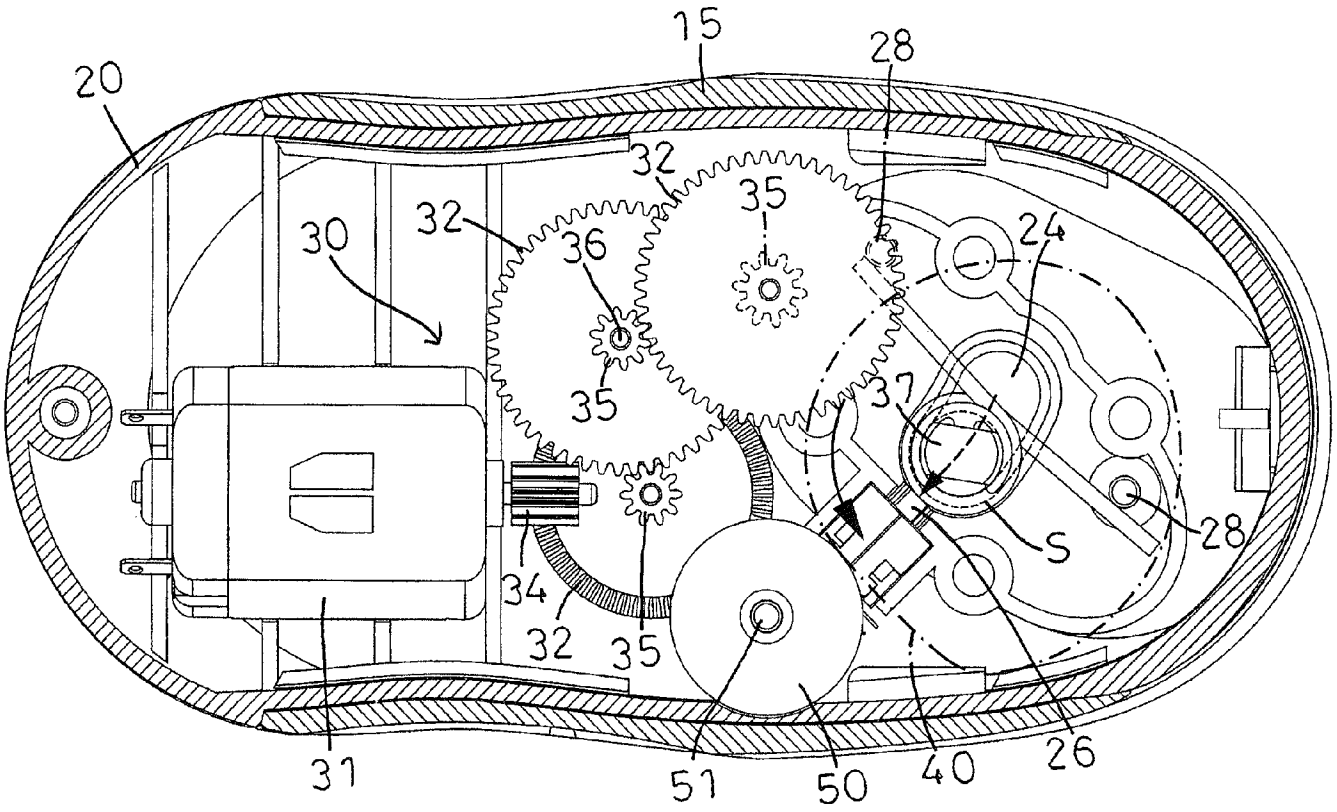
FIG. 14 is another cross sectional view showing the operation of the can opener according to the preferred embodiment of the present invention.
Figure 15:
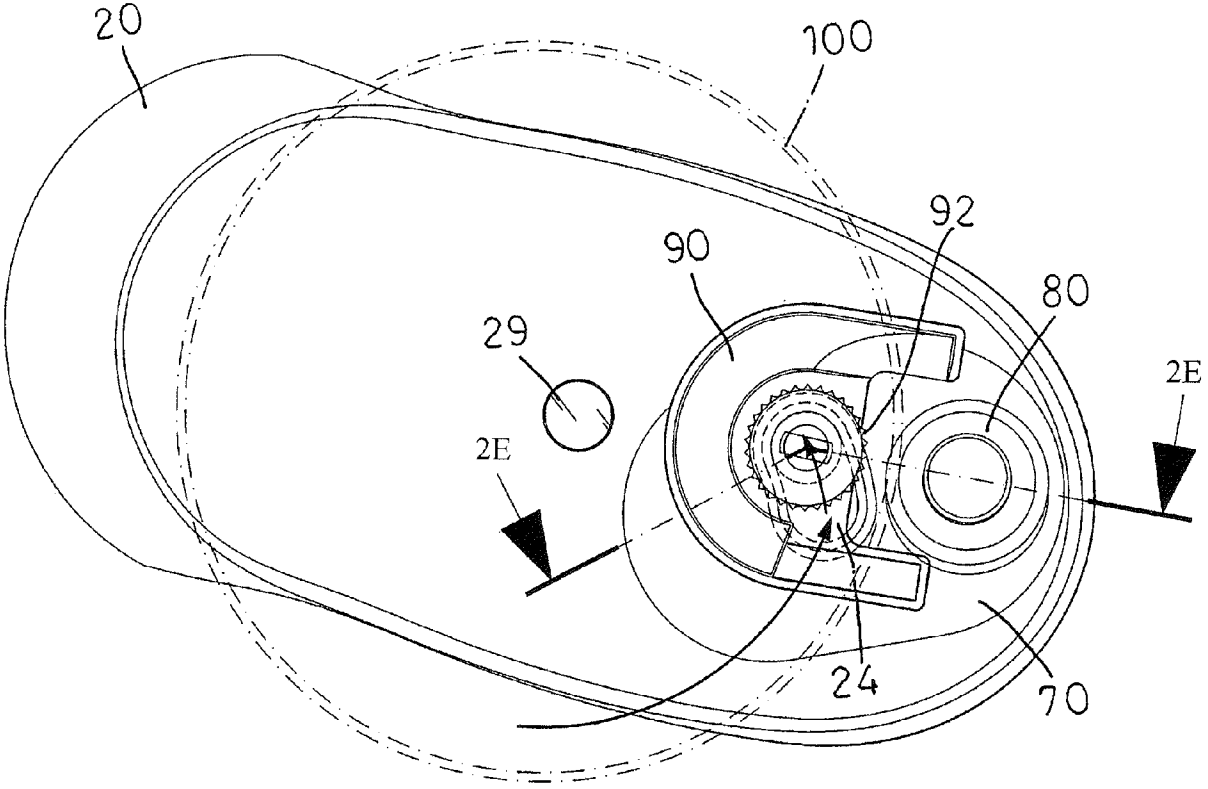
FIG. 15 is another side plane view showing the operation of the can opener according to the preferred embodiment of the present invention.
Figure 16:
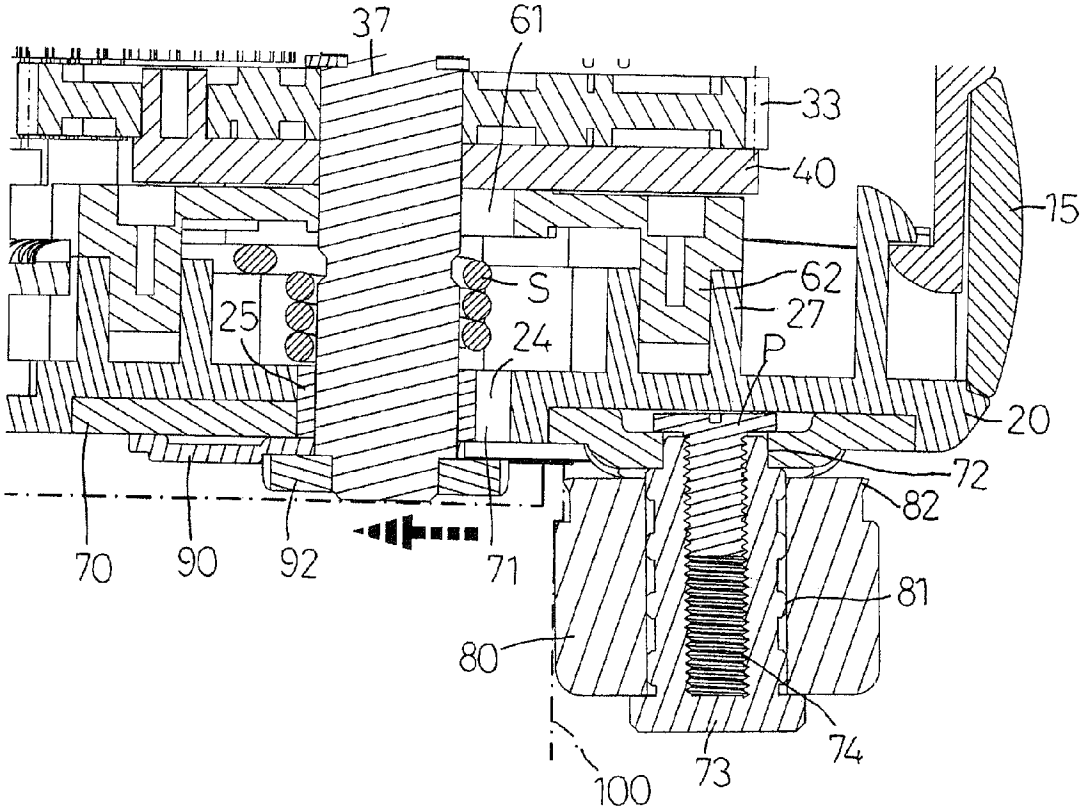
FIG. 16 is a cross sectional view taken along the line 2E-2E of FIG. 15.

With reference to FIGS. 12 and 13, the contacting gear 92 and the guiding roller 80 move close to the can 100. As illustrated in FIGS. 14 to 16, when the torsion force of the torsion spring S is less than the resistance force of opening the can 100, the torsion spring S pushes the central column 37 of the contacting gear 92 to move inwardly and to contact with the second switch 26, such that the motor 31 is stopped and the contacting gear 92 moves away from the guiding roller 80.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A can opener comprising: a first holder, a second holder, a transmission device, an eccentric gear, a rotating roller, a connector, a washer, a guiding roller, and a metal piece; wherein the first holder includes a battery chamber and a cover which are arranged on an upper side of the first holder, the second holder is located below the first holder, and the battery chamber is configured to house two batteries configured so as to supply power source, the first holder also includes a first switch disposed on a front end thereof, and the cover has a button mounted on a front end thereof and corresponding to the first switch, such that the button is pressed to turn on the first switch so as to conduct the power source;

the second holder includes a first accommodation room configured in a rear end thereof so as to house a motor, a plurality of first posts arranged in a front end thereof so as to fix the transmission device, and a second accommodation room defined in the front end thereof, wherein the second accommodation room has a first arcuate orifice formed therein and has an arcuate fitting element arranged on an inner wall of the first arcuate orifice, the second holder further includes a second switch disposed on one side thereof and corresponding to the first arcuate orifice, and the second switch is configured to turn off the power source after being pressed by a user, the second holder further includes a plurality of first coupling stems mounted on a first peripheral side of the second accommodation room so as to connect with the connector, and the second holder further includes two first positioning pillars arranged on a second peripheral side of the second accommodation room so as to position two feet of a torsion spring, wherein the washer is secured on a front end of the outer surface of the second holder;

the transmission device includes the motor, a plurality of first driving gears, and a second driving gear, wherein the motor has a third driving gear, and each first driving gear has a fourth driving gear fixed on a central position thereof, wherein one of the plurality of first driving gears meshes with and, drives the second driving gear by using its fourth driving gear, and another of the plurality of first driving gears meshes with the third driving gear of the motor, said each first driving gear is rotatably connected with each of a plurality of central shafts and is fixed in each of the plurality of first posts of the second holder, such that the motor drives the second driving gear to rotate via the third driving gear, the plurality of first driving gears, and the fourth driving gear of said each first driving gear, the second driving gear has a central column disposed on a central position thereof and inserting into a central hole of the torsion spring, and the second driving gear also includes a plurality of connection apertures formed thereon and configured to fix the eccentric gear;

the eccentric gear includes an opening corresponding to the central column and configured to accommodate the central column, the eccentric gear also includes a plurality of coupling pillars, and each coupling pillar corresponds to and connects with each of the plurality of connection apertures, wherein the eccentric gear is located beside the rotating roller;

the rotating roller includes a second post mounted on a central position thereof and rotatably connecting with one of the plurality of first posts, such that rotating roller rotatably contacts with the eccentric gear;

the connector includes a second arcuate orifice corresponding to the first arcuate orifice and configured to extend the central column outwardly, a plurality of second coupling stems corresponding to and coupling with the plurality of first coupling stems of the second accommodation room, and two second positioning pillars, wherein each of the two second positioning pillars corresponds to and connects with each of the two first positioning pillars of the second accommodation room;

the washer includes a third arcuate orifice corresponding to the first arcuate orifice of the second accommodation room, and the washer includes a fixing hole defined on a front end thereof so as to accommodate a screw and to screw with a screwing hole of a shank, wherein the shank rotatably connects with the guiding roller, and the metal piece is fixed below the washer;

the guiding roller includes a first pore configured to accommodate the shank and includes an abutting portion configured to abut against a can; and the metal piece includes a second pore configured to extend the central column outwardly and includes a contacting gear coupled with a distal end of the central column and configured to abut against the can.

2. The can opener as claimed in claim 1, wherein a C-shaped fixer is fixed on the front end of the first holder and the front end of the second holder so as to connect the first holder and the second holder together.

3. The can opener as claimed in claim 1, wherein the second holder further includes a magnetic attraction element fixed on a middle portion of an outer surface thereof.

* * * * *